US012428829B2

(12) United States Patent
Pontarelli

(10) Patent No.: US 12,428,829 B2
(45) Date of Patent: Sep. 30, 2025

(54) TRENCH SYSTEM

(71) Applicant: PKG Equipment Inc., Rochester, NY (US)

(72) Inventor: Stephen Thomas Pontarelli, Rochester, NY (US)

(73) Assignee: PKG Equipment Inc., Rochester, NY (US)

( * ) Notice: Subject to any disclaimer, the term of this patent is extended or adjusted under 35 U.S.C. 154(b) by 109 days.

(21) Appl. No.: 18/483,125

(22) Filed: Oct. 9, 2023

(65) Prior Publication Data

US 2024/0125106 A1 Apr. 18, 2024

Related U.S. Application Data

(60) Provisional application No. 63/379,300, filed on Oct. 13, 2022.

(51) Int. Cl.
*E03F 5/04* (2006.01)
*E03F 3/04* (2006.01)
*E03F 3/06* (2006.01)

(52) U.S. Cl.
CPC ..... *E03F 3/046* (2013.01); *E03F 3/06* (2013.01); *E03F 5/0407* (2013.01)

(58) Field of Classification Search
CPC ..... E03F 3/046; E03F 2005/0413; E03F 5/06; E03F 2005/0414; E03F 5/04; E01C 11/227
See application file for complete search history.

(56) References Cited

U.S. PATENT DOCUMENTS 4,786,088 A * 11/1988 Ziu ..... F16L 9/18 285/133.11
4,878,782 A * 11/1989 Beattie ..... E02B 13/00 405/119
5,613,804 A * 3/1997 Beamer ..... E03F 3/046 405/118
5,718,537 A * 2/1998 Becker ..... E01C 11/227 405/121

(Continued)

FOREIGN PATENT DOCUMENTS

WO WO-2022042849 A1 * 3/2022 ..... E03F 1/002

*Primary Examiner* — Benjamin F Fiorello
(74) *Attorney, Agent, or Firm* — Heslin Rothenberg Farley & Mesiti P.C.

(57) ABSTRACT

A trench system includes a trench body operable to contain chemicals without corroding. The trench body includes a trench floor having a longitudinal length and a lateral width. A pair of first and second sidewalls is welded to opposing longitudinal perimeters of the trench floor and extend vertically upwards therefrom. Wall support ribs are attached to outer surfaces of the first and second sidewalls and extend laterally outward and vertically upward therefrom. Floor support ribs are attached to an outer surface of the trench floor and extend vertically downward therefrom. A vertically extending anchoring slot is attached to an outer distal edge of each wall support rib. Each anchoring slot is configured to receive a metal reinforcement bar therethrough at an acute angle to the wall support ribs. The metal reinforcement bars are operable to reinforce concrete poured around the outer surfaces of the first and second sidewalls.

23 Claims, 5 Drawing Sheets

(56) References Cited

U.S. PATENT DOCUMENTS

| | | | | |
|---|---|---|---|---|
| 5,735,637 | A * | 4/1998 | Gunter | E03F 3/046 405/36 |
| 5,971,662 | A * | 10/1999 | Becker | E03F 3/046 404/2 |
| 6,220,784 | B1 * | 4/2001 | Bricker | E03F 3/046 249/11 |
| 6,905,285 | B2 * | 6/2005 | Little | E01C 11/227 405/36 |
| 8,475,079 | B2 * | 7/2013 | Humphries | E03F 3/046 249/11 |
| 11,021,864 | B1 * | 6/2021 | Mjelde | E04H 4/06 |
| 2002/0154952 | A1 * | 10/2002 | Gunter | E01C 19/506 405/121 |
| 2003/0082009 | A1 * | 5/2003 | Humphries | E03F 3/046 405/118 |
| 2004/0136785 | A1 * | 7/2004 | Gunter | E03F 3/046 405/36 |
| 2005/0025572 | A1 * | 2/2005 | Sanfilippo | E03F 3/046 405/36 |
| 2009/0097921 | A1 * | 4/2009 | Hetzler | E03F 3/046 405/119 |
| 2009/0103982 | A1 * | 4/2009 | Hodgekins | E04G 15/061 405/118 |
| 2014/0147210 | A1 * | 5/2014 | Lee | E01C 11/227 405/36 |
| 2017/0241121 | A1 * | 8/2017 | Files, Jr. | E01C 11/227 |
| 2023/0287672 | A1 * | 9/2023 | Meier | E03F 3/046 |

* cited by examiner

TRENCH SYSTEM

CROSS REFERENCE TO RELATED APPLICATIONS

This application is a non-provisional of, and claims the benefit of the filing date of, U.S. provisional application 63/379,300, filed Oct. 13, 2022, entitled: "TRENCH SYSTEM," the contents of which are incorporated herein by reference.

TECHNICAL FIELD

The present disclosure relates to trench systems and method of making the same. More specifically, the disclosure relates to pitched trench systems and methods of making the same.

BACKGROUND

Chemical process equipment, especially industrial chemical process equipment, requires systems that can deliver various chemicals to and from the equipment that is performing the chemical process. Additionally, such chemical process equipment requires systems that can protect and contain chemical spills if something goes wrong.

Pipes are often used to deliver chemicals to such chemical process equipment. Unfortunately, the pipes can become an obstruction to the egress and access of the equipment.

Trench systems are often used to contain chemical spills. Unfortunately, there are several problems associated with such prior art trench systems.

For example, the trench systems are often installed in a trench pit and held in place with concrete. However, prior art trench systems are held in place by wires as the concrete is poured around the outside of the trench system. These wires often do not provide adequate support, so the trench system may shift or be raised up from the floor during the concrete pouring process, resulting in a trench system that may extend above the level of the floor and could potentially pose a hazard to foot traffic.

Additionally, some prior art trench systems are stabilized during the concrete pouring process by nailing through the trench system walls. Unfortunately, this increases the potential for chemical leaks during a chemical spill. The nail holes can be sealed after they are inserted, but this takes time and cannot completely eliminate the potential for a leak.

Additionally, some prior art trench systems must have their trench pits dug at a certain pitch since the prior art trench system itself is at a pitch in order to gravity feed chemical spills downhill in the direction of a drain or a pump. However, digging a trench pit at a uniform pitch is difficult and time consuming.

Accordingly, there is a need for a trench system that substantially eliminates the potential for a leak. Additionally, there is a need for a trench system that can be stabilized such that it will not shift during the concrete pouring process and will not raise above the floor level. Additionally, there is a need for a trench system that better enables the reinforcement of the concrete during and after the pouring process. Additionally, there is a need for removing the potential obstructions caused by pipes that deliver chemicals to and from chemical equipment. Additionally, there is a need to eliminate the need to dig a trench pit at a certain pitch even if the trench system requires that certain pitch to gravity feed a chemical spill downhill toward a drain or pump.

BRIEF DESCRIPTION

The present disclosure offers advantages and alternatives over the prior art by providing a trench system that includes wall support ribs attached to the sidewalls of a generally rectangular trench body. The support ribs advantageously include anchoring slots that are configured to receive a metal reinforcement bar that can reinforce the concrete once it has been poured. Additionally, once the metal reinforcement bars are installed within the anchoring slots, they provide an enhanced stabilization of the trench system over prior art wire supports, such that the potential for the trench system to shift during the concrete pouring process is greatly reduced. Additionally, the combination of the anchoring slots and metal reinforcement bars provide a stabilization system of the trench system that does not require nailing and, therefore, greatly reduces the potential for leaks to occur.

Additionally, a plurality of pipe supports may be added to the inner surfaces of the trench sidewalls. The pipe supports can support pipes that are used to carry chemicals to and from the chemical equipment, and therefore, move the pipes under the floor level and within the trench system. This advantageously removes the obstruction to foot traffic that the pipes can cause. Additionally, advantageously, the trench system may now act as a secondary containment system for breached pipes and may provide easy access for visual inspection of the below floor level piping.

These and other advantages of trench systems in accordance with aspects of the present disclosure are discussed in detail herein.

An example of a trench system in accordance with one or more aspects of the present disclosure includes a trench body operable to contain a plurality of chemicals without corroding. The trench body includes a trench floor having a longitudinal length and a lateral width. A pair of first and second sidewalls are welded to opposing longitudinal perimeters of the trench floor and extend vertically upwards therefrom. Wall support ribs are attached to outer surfaces of the first and second sidewalls and extend laterally outward and vertically upward therefrom. Floor support ribs are attached to an outer surface of the trench floor and extend vertically downward therefrom. A vertically extending anchoring slot is attached to an outer distal edge of each wall support rib. Each anchoring slot is configured to receive a metal reinforcement bar therethrough at an acute angle to the upward extending wall support ribs. The metal reinforcement bars are operable to reinforce concrete poured around the outer surfaces of the first and second sidewalls.

Another example of a trench system in accordance with one or more aspects of the present disclosure includes a trench body operable to contain a plurality of chemicals without corroding. The trench body includes a trench floor having a longitudinal length and a lateral width. A pair of first and second sidewalls are welded to opposing longitudinal perimeters of the trench floor and extend vertically upwards therefrom. Wall support ribs are attached to outer surfaces of the first and second sidewalls and extend laterally outward and vertically upward therefrom. Floor support ribs are attached to an outer surface of the trench floor and extend vertically downward therefrom. A plurality of pipe supports is configured to provide structural support to pipes that are operable to have the plurality of chemicals flow therethrough without corroding. The pipe supports are operable to attach to an inner surface of the first and second side walls.

In some examples of the trench system, the anchoring slots are configured to receive the metal reinforcement bar therethrough at an angle of about between 15 degrees and 5 degrees to the upwardly extending wall support ribs.

In some examples of the trench system, the anchoring slots are configured to receive the metal reinforcement bar therethrough at an angle of about between 10 degrees and 6 degrees to the upwardly extending wall support ribs.

In some examples of the trench system, the metal reinforcement bar has an outside diameter within a range of about ⅜ inches to 1 inches.

In some examples of the trench system, a plurality of pipe supports is configured to provide structural support to pipes that are operable to have the plurality of chemicals flow therethrough without corroding. The pipe supports are operable to attach to an inner surface of the first and second side walls.

In some examples of the trench system the pipe supports are welded to the inner surfaces of the first and second side walls.

In some examples of the trench system, the pipe supports are removably attached to rails that are welded to inner surfaces of the first and second side walls.

In some examples of the trench system, the trench system has a front end portion and an opposing rear end that are spaced apart in a longitudinal direction of the trench system. The trench system has a substantially constant overall height from the front end portion to the rear end portion. The overall height of the trench system includes a height of the trench body and a height of the floor support ribs. The height of the trench body is uniformly decreased from the front end portion to the rear end portion to provide a constant pitch along the longitudinal direction of the trench body. The height of the floor support ribs is uniformly increased from the front end portion to the rear end portion to compensate for the pitch of the trench body and to keep the overall height of the trench system substantially constant.

In some examples of the trench system, a pair of first and second rims are attached to the upper distal ends of the first and second side walls respectively. The first and second rims extend longitudinally along, and laterally outward from, the upper distal ends of the first and second sidewalls. A perforated, fabric backed thermoplastic top sheet is welded to each upper surface of the first and second rims. The rims are operable to lay on a top surface of a concrete floor when the trench system is installed in a trench pit. The top sheet is operable to bond with a concrete floor coating to prevent the trench system from separating from the concrete floor.

In some examples of the trench system the trench floor and first and second sidewalls are composed of the same corrosion resistant thermoplastic material.

In some examples of the trench system, the first and second side walls are welded to the trench floor to form a first and a second weld joint respectively. The first and second weld joints are composed of the same thermoplastic material. The thermoplastic material of the first and second weld joints has a thickness that is equal to or greater than a thickness of the first and second side walls.

An example of a method of forming a trench system in accordance with one or more aspects of the present disclosure includes welding a pair of first and second side walls to opposing longitudinal perimeters of a trench floor that extend vertically upwards therefrom to form a trench body. The trench body being operable to contain a plurality of chemicals without corroding. Wall support ribs are attached to outer surfaces of the first and second sidewalls. The wall support ribs extend laterally outward and vertically upward from the first and second sidewalls. Floor support ribs are attached to an outer surface of the trench floor. The floor support ribs extend vertically downward from the outer surface of the trench floor. A vertically extending anchoring slot is attached to an outer distal edge of each wall support rib. Each anchoring slot is configured to receive a metal reinforcement bar therethrough at an acute angle to the upward extending wall support ribs. The metal reinforcement bars are operable to reinforce concrete poured around the outer surfaces of the first and second sidewalls.

In some examples of the method, a trench pit is dug that is configured to receive the trench body, wall support ribs, floor support ribs and anchoring slots therein. Metal reinforcement bars are inserted in each of the anchoring slots at an acute angle of about between 15 degrees and 5 degrees to the upwardly extending wall support ribs. Concrete is poured at least around the outer surfaces of the first and second sidewalls. The metal reinforcement bars reinforce the poured concrete.

In some examples of the method, a plurality of pipe supports is anchored to an inner surface of the first and second sidewalls. The pipe supports are configured to provide structural support to pipes that are operable to have the plurality of chemicals flow therethrough without corroding.

In some examples of the method, the pair of first and second sidewalls are machine butt welded to the trench floor to form a first and a second weld joint respectively. The first and second weld joints have a thickness that is equal to or greater than a thickness of the first and second side walls.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

BRIEF DESCRIPTION OF THE DRAWINGS

The disclosure will be more fully understood from the following detailed description taken in conjunction with the accompanying drawings, in which.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
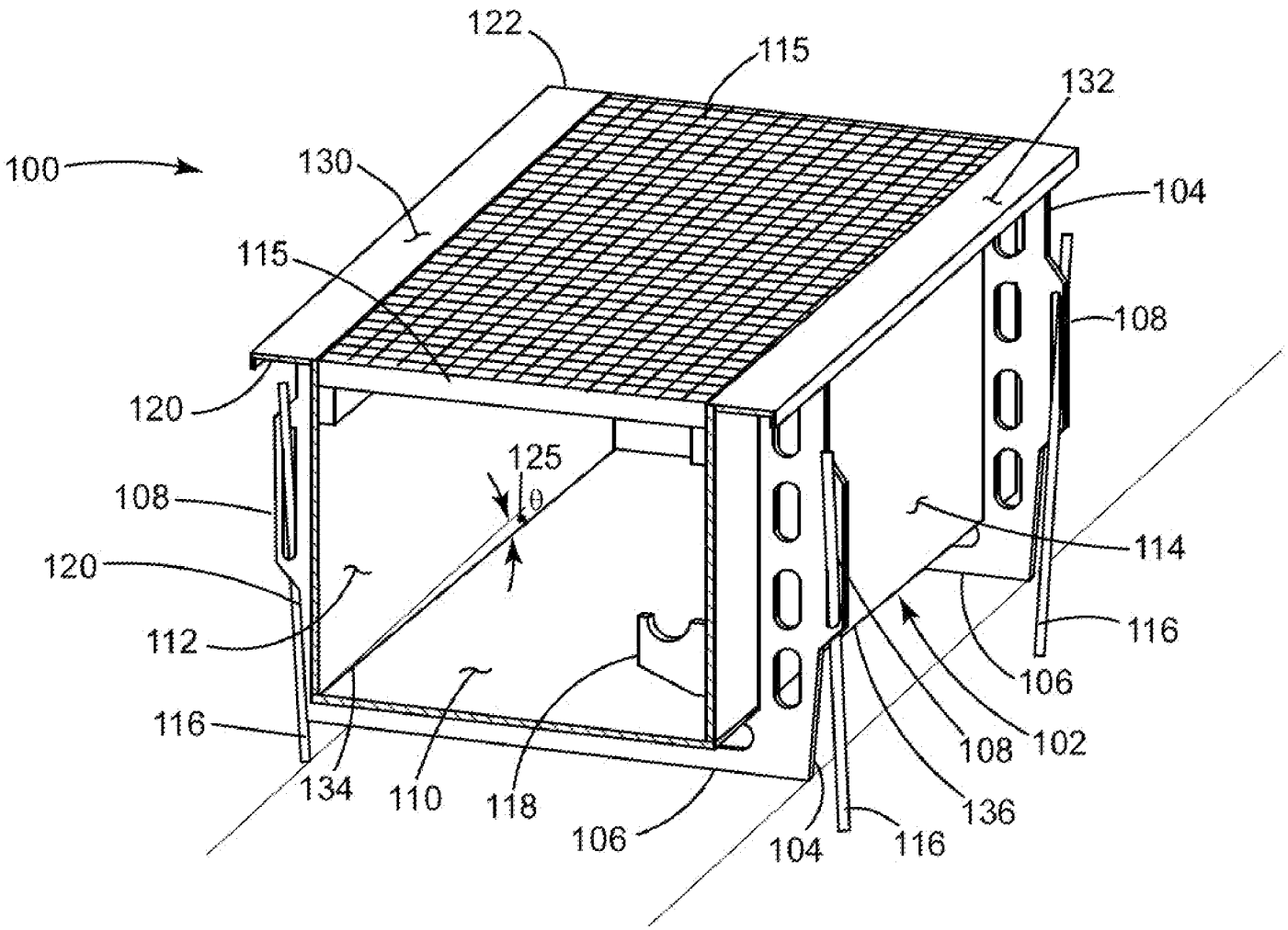
FIG. 1 depicts an example of a perspective view of a trench system, according to aspects described herein.
Figure 2:
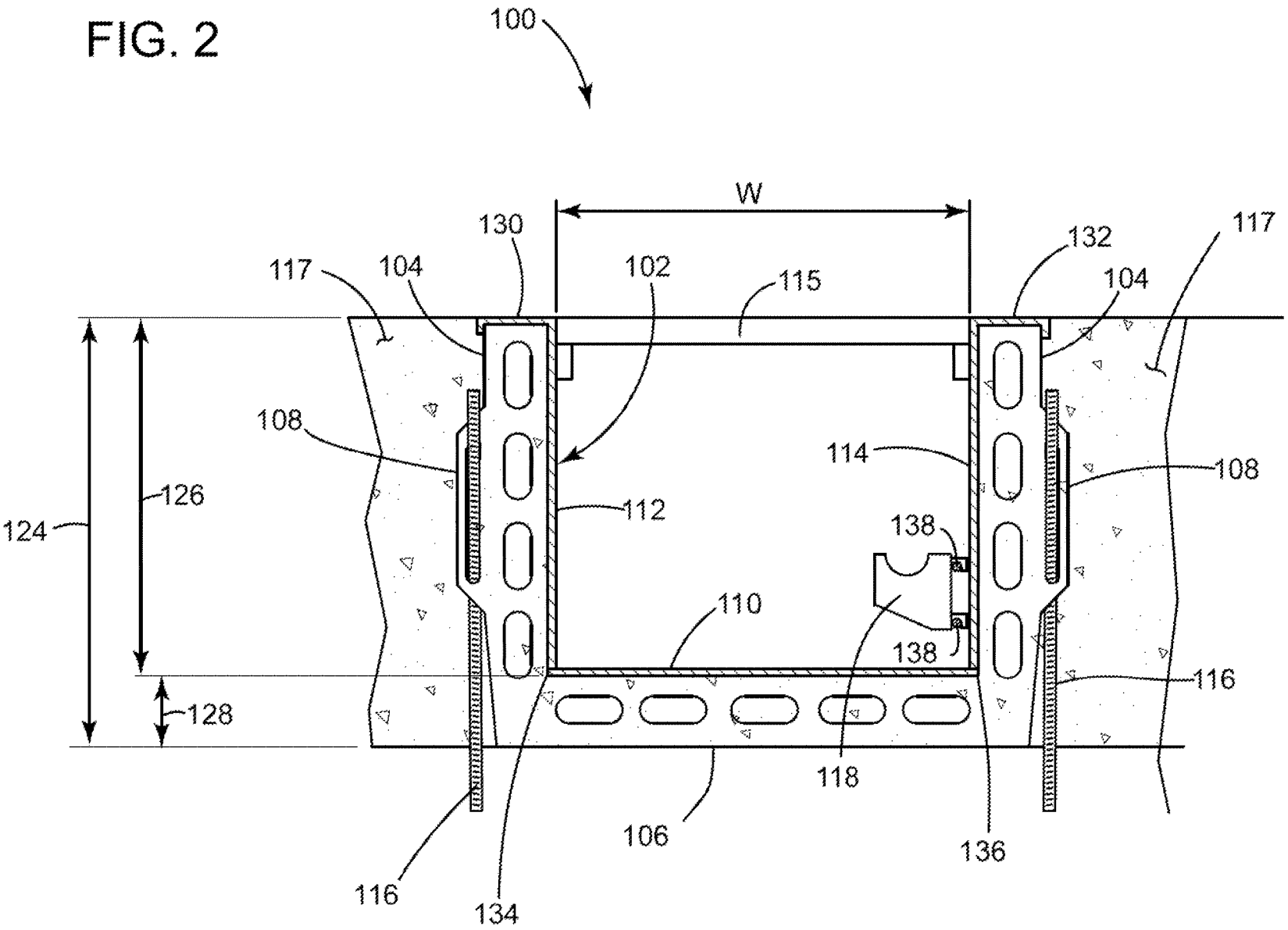
FIG. 2 depicts an example of a front view of the trench system of FIG. 1, according to aspects described herein.
Figure 3:
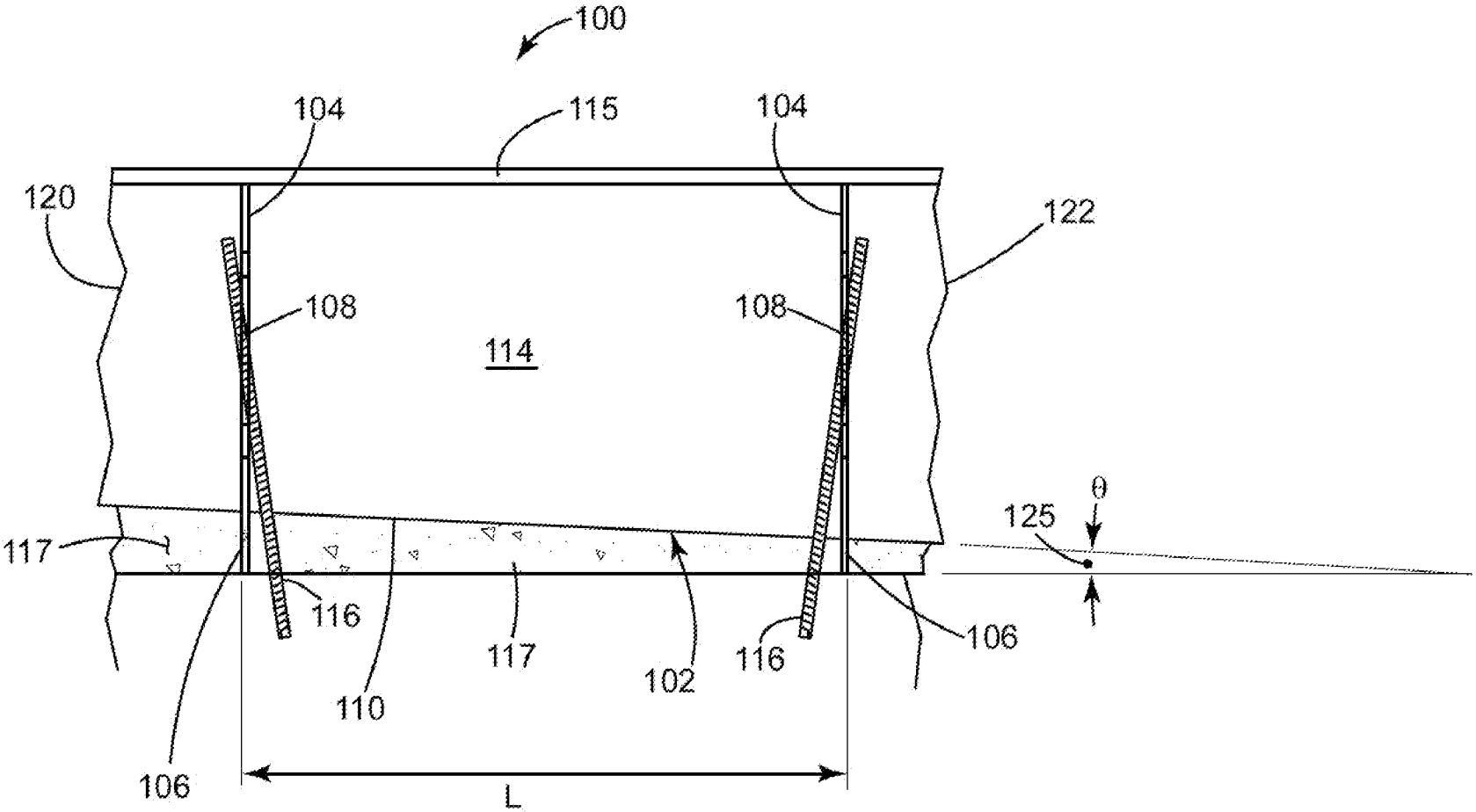
FIG. 3 depicts an example of a side view of the trench system of FIG. 1, according to aspects described herein.

Referring to FIGS. 1, 2 and 3, an example is depicted of a perspective view (FIG. 1), a front view (FIG. 2) and a side view (FIG. 3) of a trench system 100, according to aspects described herein. The trench system 100 includes a trench body 102, wall support ribs 104, floor support ribs 106 and anchoring slots 108.

The trench body 102 is operable to contain a plurality of chemicals (such as sodium hydroxide, nitric acid, chromic acid, or the like) without corroding. The trench body may be composed of a corrosion resistant thermoplastic, such as polypropylene, polyvinyl chloride, polyethylene or polyvinylidene, which may handle chemicals and temperatures that are not compatible with stainless steel, polymers, or polymer concrete.

The trench body 102 includes a trench floor 110, which extends in a longitudinal direction for a longitudinal length L and extends in a lateral direction for a lateral width W. The trench body 102 also includes a pair of a first sidewall 112 and a second sidewall 114 that are welded to opposing longitudinal perimeters of the trench floor 110. The first and second sidewalls 112, 114 also extend vertically upwards from the trench floor 110 at substantially right angles to the trench floor 110. The trench floor 110 and first and second sidewalls 112, 114 may be composed of the same corrosion resistant thermoplastic material discussed earlier.

A top floor grate 115 may cover the trench body 102. The top floor grate 115 prevents people from inadvertently stepping into the interior of the trench body 102 while allowing spilt fluids (e.g., chemicals) to flow through the grate 115 and into the interior of the trench body 102.

The trench body 102 may be fabricated in custom sizes and configurations by welding plastic sheets together. The custom sizes and configurations may accommodate a variety of facilities' needs. The trench floor 110 and first and second sidewalls 112, 114 of the trench body 102 may include a variety of thicknesses that can depend on the application. For example, the thicknesses of the trench floor 110 and first and second sidewalls 112, 114 may vary from about ⅜ inches to about 1.5 inches. The sheets may be machine butt welded together to produce substantially right angled weld joints with full sheet penetration welds, which may exceed the weld strengths of the parent material. The trench system 100 welded joints may be electronically leak tested prior to pouring any concrete. No sealants or dissimilar materials may be used in the fabrication of any wetted surfaces, so where sealants or dissimilar materials may eventually breakdown, the trench system 100 may stay intact.

The first and second side walls 112, 114 may be welded to the trench floor 110 to form a first weld joint 134 and a second weld joint 136 respectively. The first and second weld joints 134, 136 may be composed of the same thermoplastic material as the trench floor 110 and sidewalls 112, 114. The first and second weld joints 134, 136 may have a thickness that is equal to or greater than the thickness of the first and second side walls 112, 114. Accordingly, the strength of the welds 134, 136 may be stronger than the strength of the sidewalls 112, 114.

The wall support ribs 104 are attached to outer surfaces of the first and second sidewalls 112, 114 and extend laterally outward and vertically upward therefrom (i.e., from the first and second sidewalls 112, 114). The floor support ribs 106 are attached to an outer surface of the trench floor 110 and extend vertically downward therefrom (i.e., vertically downward from the trench floor 110.

Advantageously, a vertically extending anchoring slot 108 is attached to each wall support rib 104. The anchoring slots 108 may be attached (or positioned) on any portion of the wall support ribs 104 that is appropriate for the application. However, in the example illustrated in FIGS. 1-3, the anchoring slots 108 are attached to the outer distal edges of the wall support ribs 104.

Each anchoring slot 108 is configured to receive a metal reinforcement bar 116 (or rebar 116) therethrough at an acute angle to the upward extending wall support ribs 104. The metal reinforcement bars 116 operable to reinforce concrete 117 poured around the outer surfaces of the first and second sidewalls 112, 114, when the trench system 100 is installed in a trench pit (not shown).

The anchoring slots 108 may be configured to receive the metal reinforcement bars 116 therethrough at any acute angle that is appropriate for the application. For example, the anchoring slots 108 may receive the rebar 116 at an angle of about between 15 degrees and 5 degrees, or between about 10 degrees and 6 degrees, to the upwardly extending wall support ribs 104. In the example illustrated in these FIGS. 1-3, the rebar 116 is inserted at about an angle of 8 degrees relative to the wall support ribs 104.

Additionally, the anchoring slots 108 may be configured to receive any outside diameter rebar that is appropriate for the application. For example, the anchoring slots 108 may receive metal reinforcement bars 116 that have an outside diameter within a range of about ⅜ inches to 1 inches. In the example illustrated in these FIGS. 1-3, the rebar 116 has an outside diameter of about ⅜ inches.

Advantageously, the anchoring slots 108 with the metal rebar 116 installed therethrough can reinforce the concrete 117 once it has been poured. Additionally, once the metal reinforcement bars 116 are installed within the anchoring slots 108, they provide an enhanced stabilization of the trench system 100 over prior art wire supports, such that the potential for the trench system 100 to shift during the concrete 117 pouring process is greatly reduced. Additionally, the combination of the anchoring slots 108 and metal reinforcement bars 116 provide a stabilization system of the trench system 100 that does not require nailing and, therefore, greatly reduces the potential for leaks to occur.

Moreover, the rebar 116 can be cut to size for easy installation. Additionally, this method of installing rebar 116 into anchoring slots 108 to stabilize the trench system 100 is quicker and less complicated than using prior art tie wires.

The trench system 100 may advantageously also include a plurality of pipe supports 118. The pipe supports 118 are configured to provide structural support to pipes (not shown) that are operable to have a plurality of chemicals flow therethrough without corroding. These are the same chemicals that the trench body 102 is designed to handle without corroding. The pipe supports 118 are operable to be attached to an inner surface of the first and second side walls 112, 114. For example, the pipe supports 118 may be welded to the inner surfaces of the first and second side walls 112, 114. Alternatively, the pipe supports 118 may be removably attached to rails 138 that are welded to inner surfaces of the first and second side walls 112, 114.

The pipe supports 118 enable placement of such chemical carrying pipes within the trench body 102 of the trench system 100. This removes the potential obstruction that the same pipes could cause to foot traffic if they were above the floor level (i.e., above grade). Additionally, the trench body 102, having the pipe supports 118 disposed therein, provides a secondary system of containment for breached pipes and also enables easy visual inspection of the below grade (i.e., below floor level) piping.

The trench system 100 includes a front end portion 120 and an opposing rear end 122 that are spaced apart in a longitudinal direction of the trench system 100. The trench system may have a substantially constant overall height 124 from the front end portion 120 to the rear end portion 122. The overall height 124 of the trench system 100 includes a height 126 of the trench body 102 and a height 128 of the floor support ribs 104.

The height 126 of the trench body 102 may be uniformly decreased from the front end portion 120 to the rear end portion 122 to provide a constant pitch 125 along the longitudinal direction of the trench body 102. The height 128 of the floor support ribs 104 also may be uniformly increased from the front end portion 120 to the rear end portion 122 to compensate for the pitch 125 of the trench body 102 and to keep the overall height 124 of the trench system 100 substantially constant. The pitch 125 of the trench body 102 may form an acute angle Θ, that may vary between about 0 degrees and 20 degrees.

The constant overall height 124 with a pitched trench body 102 enables chemicals to be gravity fed toward a drain or pump, while simultaneously making it easier to excavate the site for the trench system 100 compared to prior art trench systems. This is because the pitch 125 (uniform variation in height 126) of the trench body 102 is compensated by the uniform variation in the height 128 of the floor support ribs 106. Therefore, the trench pit (not shown) that the trench system 100 will be installed in, can be excavated to a constant elevation or depth, instead of digging the trench pit to a pitched elevation.

The trench system 100 may also include a pair of a first rim 130 and a second rim 132 attached to upper distal ends of the first and second side walls 112, 114, respectively. The first and second rims 130, 132 extend longitudinally along, and laterally outward from, the upper distal ends of the first and second sidewalls 112, 114. A perforated, fabric backed thermoplastic top sheet may be integrally welded to each upper surface of the first and second rims 130, 132. The rims 130, 132 are operable to lay on a top surface of a concrete floor (not shown) when the trench system 100 is installed in a trench pit. The top sheet of the rims 130, 132 is operable to bond with a concrete floor coating (such as fiberglass coating or a polyester coating) to prevent the trench system 100 from separating from the concrete floor.

Figure 4:
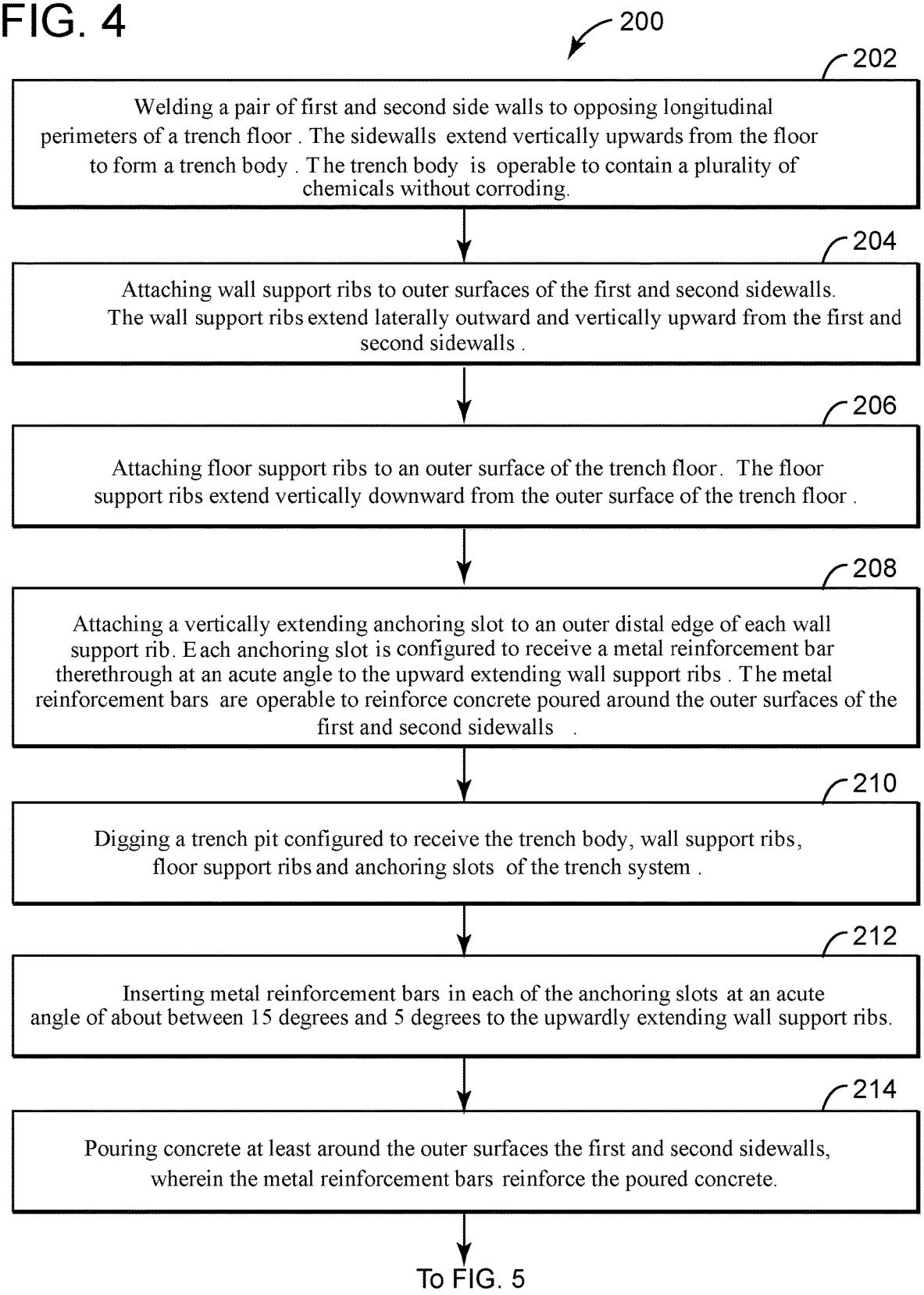
FIG. 4 depicts an example of a flow diagram of a method of forming a trench system, according to aspect described herein.

Referring to FIG. 4 an example is depicted of a flow diagram of a method 200 of forming a trench system 100, according to aspects described herein.

At 202 of the method 200, a pair of first and second side walls 112, 114 is welded to opposing longitudinal perimeters of a trench floor 110. The sidewalls 112, 114 extend vertically upwards from the floor 110 to form a trench body 102. The trench body 102 is operable to contain a plurality of chemicals without corroding.

At 204, wall support ribs 104 are attached to outer surfaces of the first and second sidewalls 112, 114. The wall support ribs 104 extend laterally outward and vertically upward from the first and second sidewalls 112, 114.

At 206, floor support ribs 106 are attached to an outer surface of the trench floor 110. The floor support ribs 106 extend vertically downward from the outer surface of the trench floor 110.

At 208, a vertically extending anchoring slot 108 is attached to an outer distal edge of each wall support rib 104. Each anchoring slot 108 is configured to receive a metal reinforcement bar 116 therethrough at an acute angle to the upward extending wall support ribs 104. The metal reinforcement bars 116 are operable to reinforce concrete 117 poured around the outer surfaces of the first and second sidewalls 112, 114.

At 210, a trench pit is dug. The trench pit is configured to receive the trench body 102, wall support ribs 104, floor support ribs 106 and anchoring slots 108 of the trench system 100.

At 212, metal reinforcement bars 116 are inserted in each of the anchoring slots 108 at an acute angle of about between 15 degrees and 5 degrees to the upwardly extending wall support ribs 104.

At 214, concrete 117 is poured at least around the outer surfaces of the first and second sidewalls 112, 114, wherein the metal reinforcement bars 116 reinforce the poured concrete 117.

Figure 5:
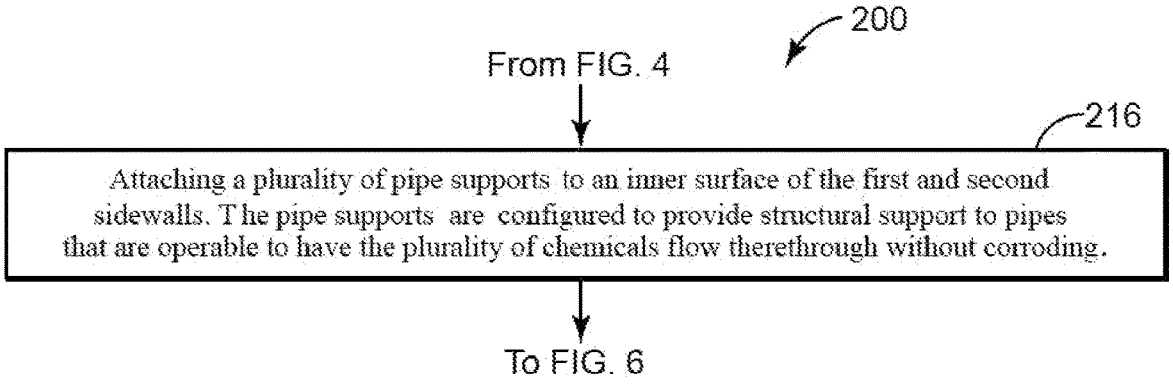
FIG. 5 depicts a continuation of the flow diagram of the method of forming a trench system of FIG. 4, according to aspects described herein.

Referring to FIG. 5, an optional continuation of the flow diagram of the method 200 of forming a trench system 100 is depicted, according to aspects described herein.

At 216 of the method 200, a plurality of pipe supports 118 are attached to an inner surface of the first and second sidewalls 112, 114. The pipe supports 118 are configured to provide structural support to pipes that are operable to have the plurality of chemicals flow therethrough without corroding.

Figure 6:
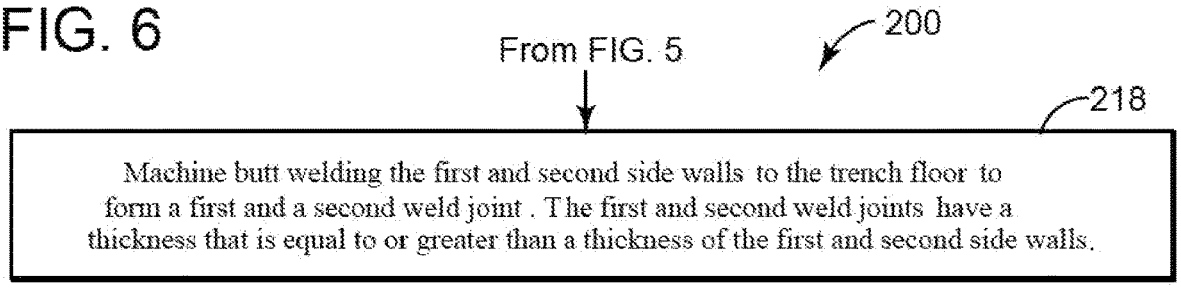
FIG. 6 depicts a continuation of the flow diagram of the method of forming a trench system of FIG. 4, according to aspects described herein.

Referring to FIG. 6, an optional continuation of the flow diagram of the method 200 of forming a trench system 100 is depicted, according to aspects described herein.

At 218 of the method 200, the first and second side walls 112, 114 are machine butt welded to the trench floor 110 to form a first weld joint 134 and a second weld joint 136 respectively. The first and second weld joints 134, 136 have a thickness that is equal to or greater than a thickness of the first and second side walls 112, 114.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure is not limited to the described examples, but that it has the full scope defined by the language of the following claims.

What is claimed is:

1. A trench system, comprising:

a trench body operable to contain a plurality of chemicals without corroding, the trench body comprising:

a trench floor having a longitudinal length and a lateral width, and a pair of first and second sidewalls welded to opposing longitudinal perimeters of the trench floor and extending vertically upwards therefrom;

wall support ribs attached to outer surfaces of the first and second sidewalls and extending laterally outward and vertically upward therefrom;

floor support ribs attached to an outer surface of the trench floor and extending vertically downward therefrom;

a vertically extending anchoring slot attached to each wall support rib, each anchoring slot configured to receive a metal reinforcement bar therethrough at an acute angle to the upward extending wall support ribs, the metal reinforcement bars operable to reinforce concrete poured around the outer surfaces of the first and second sidewalls;

the trench system having a front end portion and an opposing rear end that are spaced apart in a longitudinal direction of the trench system; and the trench system having a substantially constant overall height from the front end portion to the rear end portion, the overall height of the trench system including a height of the trench body and a height of the floor support ribs;

wherein the height of the trench body is uniformly decreased from the front end portion to the rear end portion to provide a constant pitch along the longitudinal direction of the trench body and the height of the floor support ribs are uniformly increased from the front end portion to the rear end portion to compensate for the pitch of the trench body and to keep the overall height of the trench system substantially constant.

2. The trench system of claim 1, wherein the anchoring slot is attached to an outer distal edge of each wall support rib.

3. The trench system of claim 1, comprising:

the anchoring slots configured to receive the metal reinforcement bar therethrough at an angle of about between 15 degrees and 5 degrees to the upwardly extending wall support ribs.

4. The trench system of claim 1, comprising:

the anchoring slots configured to receive the metal reinforcement bar therethrough at an angle of about between 10 degrees and 6 degrees to the upwardly extending wall support ribs.

5. The trench system of claim 1, wherein the metal reinforcement bar has an outside diameter within a range of about ⅜ inches to 1 inches.

6. The trench system of claim 1, comprising:

a plurality of pipe supports, configured to provide structural support to pipes that are operable to have the plurality of chemicals flow therethrough without corroding, the pipe supports being operable to attach to an inner surface of the first and second side walls.

7. The trench system of claim 6, wherein the pipe supports are welded to the inner surfaces of the first and second side walls.

8. The trench system of claim 6, wherein the pipe supports are removably attached to rails that are welded to inner surfaces of one of the first and second side walls.

9. The trench system of claim 1, comprising:

a pair of first and second rims attached to upper distal ends of the first and second side walls respectively, the first and second rims extending longitudinally along, and laterally outward from, the upper distal ends of the first and second sidewalls; and a perforated, fabric backed thermoplastic top sheet welded to each upper surface the first and second rims;

wherein the rims are operable to lay on a top surface of a concrete floor when the trench system is installed in a trench pit; and wherein the top sheet is operable to bond with a concrete floor coating to prevent the trench system from separating from the concrete floor.

10. The trench system of claim 1, wherein the trench floor and first and second sidewalls are comprised of a same corrosion resistant thermoplastic material.

11. The trench system of claim 10, wherein:

the first and second side walls are welded to the trench floor to form a first and a second weld joint respectively:

the first and second weld joints are comprised of the same thermoplastic material; and the first and second weld joints have a thickness that is equal to or greater than a thickness of the first and second side walls.

12. A trench system, comprising:

a trench body operable to contain a plurality of chemicals without corroding, the trench body comprising:

a trench floor having a longitudinal length and a lateral width, and a pair of first and second sidewalls welded to opposing longitudinal perimeters of the trench floor and extending vertically upwards therefrom;

wall support ribs attached to outer surfaces of the first and second sidewalls and extending laterally outward and vertically upward therefrom;

floor support ribs attached to an outer surface of the trench floor and extending vertically downward therefrom;

a plurality of pipe supports, configured to provide structural support to pipes that are operable to have the plurality of chemicals flow therethrough without corroding, the pipe supports being operable to attach to an inner surface of the first and second side walls;

the trench system having a front end portion and an opposing rear end that are spaced apart in longitudinal direction of the trench system; and the trench system having a substantially constant overall height from the front end portion to the rear end portion, the overall height of the trench system including a height of the trench body and a height of the floor support ribs;

wherein the height of the trench body is uniformly decreased from the front end portion to the rear end portion to provide a constant pitch along the longitudinal direction of the trench body and the height of the floor support ribs are uniformly increased from the front end portion to the rear end portion to compensate for the pitch of the trench body and to keep the overall height of the trench system substantially constant.

13. The trench system of claim 12, wherein the pipe supports are welded to the inner surfaces of the first and second side walls.

14. The trench system of claim 12, wherein the pipe supports are removably attached to rails that are welded to inner surfaces of one of the first and second side walls.

15. The trench system of claim 12, comprising:

a pair of first and second rims attached to upper distal ends of the first and second side walls respectively, the first and second rims extending longitudinally along, and laterally outward from, the upper distal ends of the first and second sidewalls; and a perforated, fabric backed thermoplastic top sheet welded to each upper surface of the first and second rims;

wherein the rims are operable to lay on a top surface of a concrete floor when the trench system is installed in a trench pit; and wherein the top sheet is operable to bond with a concrete floor coating to prevent the trench system from separating from the concrete floor.

16. The trench system of claim 12, wherein the trench floor and first and second sidewalls are comprised of a same corrosion resistant thermoplastic material.

17. The trench system of claim 16, wherein:

the first and second side walls are welded to the trench floor to form a first and a second weld joint respectively:

the first and second weld joints are comprised of the same thermoplastic material; and the first and second weld joints have a thickness that is equal to or greater than a thickness of the first and second side walls.

18. A method of forming a trench system, comprising:

welding a pair of first and second side walls to opposing longitudinal perimeters of a trench floor that extend vertically upwards therefrom to form a trench body, the trench body operable to contain a plurality of chemicals without corroding;

attaching wall support ribs to outer surfaces of the first and second sidewalls, the wall support ribs extending laterally outward and vertically upward from the first and second sidewalls;

attaching floor support ribs to an outer surface of the trench floor, the floor support ribs extending vertically downward from the outer surface of the trench floor; and attaching a vertically extending anchoring slot to an outer distal edge of each wall support rib, each anchoring slot configured to receive a metal reinforcement bar therethrough at an acute angle to the upward extending wall support ribs, the metal reinforcement bars operable to reinforce concrete poured around the outer surfaces of the first and second sidewalls;

wherein the formed trench system comprises:

a front end portion and an opposing rear end that are spaced apart in a longitudinal direction of the trench system, a substantially constant overall height from the front end portion to the rear end portion, the overall height of the trench system including a height of the trench body and a height of the floor support ribs, and the height of the trench body is uniformly decreased from the front end portion to the rear end portion to provide a constant pitch along the longitudinal direction of the trench body and the height of the floor support ribs are uniformly increased from the front end portion to the rear end portion to compensate for the pitch of the trench body and to keep the overall height of the trench system substantially constant.

19. The method of claim 18, comprising:

digging a trench pit configured to receive the trench body, wall support ribs, floor support ribs and anchoring slots therein;

inserting metal reinforcement bars in each of the anchoring slots at an acute angle of about between 15 degrees and 5 degrees to the upwardly extending wall support ribs; and pouring concrete at least around the outer surfaces of the first and second sidewalls;

wherein the metal reinforcement bars reinforce the poured concrete.

20. The method of claim 19, comprising:

attaching a plurality of pipe supports to an inner surface of the first and second sidewalls, the pipe supports configured to provide structural support to pipes that are operable to have the plurality of chemicals flow therethrough without corroding.

21. The method of claim 18, wherein the welding of the pair of first and second sidewalls comprises:

machine butt welding the first and second side walls to the trench floor to form a first and a second weld joint respectively; and wherein the first and second weld joints have a thickness that is equal to or greater than a thickness of the first and second side walls.

22. A trench system, comprising:

a trench body operable to contain a plurality of chemicals without corroding, the trench body comprising:

a trench floor having a longitudinal length and a lateral width, and a pair of first and second sidewalls welded to opposing longitudinal perimeters of the trench floor and extending vertically upwards therefrom;

wall support ribs attached to outer surfaces of the first and second sidewalls and extending laterally outward and vertically upward therefrom;

floor support ribs attached to an outer surface of the trench floor and extending vertically downward therefrom;

a vertically extending anchoring slot attached to each wall support rib, each anchoring slot configured to receive a metal reinforcement bar therethrough at an acute angle to the upward extending wall support ribs, the metal reinforcement bars operable to reinforce concrete poured around the outer surfaces of the first and second sidewalls;

a pair of first and second rims attached to upper distal ends of the first and second side walls respectively, the first and second rims extending longitudinally along, and laterally outward from, the upper distal ends of the first and second sidewalls; and a perforated, fabric backed thermoplastic top sheet welded to each upper surface the first and second rims;

wherein the rims are operable to lay on a top surface of a concrete floor when the trench system is installed in a trench pit; and wherein the top sheet is operable to bond with a concrete floor coating to prevent the trench system from separating from the concrete floor.

23. A trench system, comprising:

a trench body operable to contain a plurality of chemicals without corroding, the trench body comprising:

a trench floor having a longitudinal length and a lateral width, and a pair of first and second sidewalls welded to opposing longitudinal perimeters of the trench floor and extending vertically upwards therefrom;

wall support ribs attached to outer surfaces of the first and second sidewalls and extending laterally outward and vertically upward therefrom;

floor support ribs attached to an outer surface of the trench floor and extending vertically downward therefrom;

a vertically extending anchoring slot attached to each wall support rib, each anchoring slot configured to receive a metal reinforcement bar therethrough at an acute angle to the upward extending wall support ribs, the metal reinforcement bars operable to reinforce concrete poured around the outer surfaces of the first and second sidewalls;

a plurality of pipe supports, configured to provide structural support to pipes that are operable to have the plurality of chemicals flow therethrough without corroding, the pipe supports being operable to attach to an inner surface of the first and second side walls;

wherein the pipe supports are removably attached to rails that are welded to inner surfaces of one of the first and second side walls.

* * * * *